United States Patent [19]

Teske

[11] Patent Number: 4,911,558

[45] Date of Patent: Mar. 27, 1990

[54] SCREW CONVEYOR

[76] Inventor: Lothar Teske, Hegelstrasse 15, 5000 Köln 90, Fed. Rep. of Germany

[21] Appl. No.: 210,821

[22] Filed: Jun. 24, 1988

[30] Foreign Application Priority Data

Jun. 30, 1987 [DE] Fed. Rep. of Germany ..... 3721533

[51] Int. Cl.[4] ..... B01F 7/08

[52] U.S. Cl. ..... 366/300; 366/301; 366/320; 366/322; 366/326; 366/331; 198/677

[58] Field of Search ..... 366/291-301, 366/326, 331, 332, 20, 27, 28, 35, 38, 42, 50, 59, 79, 100, 133, 156, 158, 186, 271, 254, 318, 320, 322; 198/660, 662, 676, 677; 222/240, 241, 412, 413

[56] References Cited

U.S. PATENT DOCUMENTS

| | | | |
|---|---|---|---|
| 635,412 | 10/1899 | Wurster | 366/300 |
| 2,570,042 | 10/1951 | West | 366/300 |
| 2,727,732 | 12/1955 | Plumb et al. | 366/331 |
| 2,961,224 | 11/1960 | Wright | 366/297 |
| 3,090,606 | 5/1963 | Burnet | 366/326 |
| 3,116,745 | 1/1964 | Burning | 366/331 |
| 3,638,920 | 1/1970 | Davis | 366/300 |
| 3,719,506 | 3/1973 | Ehrgott | 366/326 |
| 3,901,483 | 8/1975 | Lasar | 366/299 |
| 3,941,357 | 3/1976 | Wurtz | 366/300 |

FOREIGN PATENT DOCUMENTS

| | | | |
|---|---|---|---|
| 219471 | 4/1987 | European Pat. Off. | 366/292 |
| 734521 | 12/1939 | Fed. Rep. of Germany | 366/297 |
| 3543745 | 6/1987 | Fed. Rep. of Germany | 366/292 |
| 463337 | 3/1937 | United Kingdom | 366/300 |

OTHER PUBLICATIONS

Japanese Patent Abstract M-181 of Dec. 22, 1982, vol. 6, No. 263.

*Primary Examiner*—Harvey C. Hornsby
*Assistant Examiner*—Joseph S. Machuga
*Attorney, Agent, or Firm*—Herbert Dubno

[57] ABSTRACT

The screw conveyor has at least one feed and mixing screw having a plurality of vanes extending radially from a shaft arranged in at least one series like a coil or spiral. In particular, the screw conveyor can have at least two substantially equal motorized feed and mixing screws rotating in opposite rotational directions and positioned substantially parallel with each other in a common trough. The screws are located beside each other spaced so that the vanes of one screw engage in the gaps between the vanes of the neighboring screw. To maintain at least as thorough a mixing of bulk materials as was the case heretofore while achieving a reduction in the structural length of the screw conveyor the screws are each provided with more than one helical flight of vanes.

6 Claims, 3 Drawing Sheets

SCREW CONVEYOR

FIELD OF THE INVENTION

My present invention relates to a conveyor, especially a screw conveyor. More particularly, the invention relates to a screw conveyor having at least two motorized feed and mixing screws rotating in opposite rotational directions and extending parallel to each other longitudinally in a common trough. The two feed and mixing screws each have a plurality of vanes spaced in series arranged along a helix or coil, each vane extending radially from a respective shaft so that the plurality of vanes forms a mixing and displacing helical flight. The feed and mixing screws are spaced from each other laterally so that the vanes of one of the screws engage in the trough of the flight of the adjacent screw.

BACKGROUND OF THE INVENTION

Conveyors for feeding and mixing bulk materials are known.

In known screw conveyors with a single feed screw, the open trough has a maximum inside width which corresponds approximately to the diameter of the screw and the base of the trough is circular over half the circumference of the screw. The radius of curvature of the circular base is about equal to the radius of the screw.

In the known screw conveyor with two equal and parallel feed and mixing screws located in a common trough with interfitting of the flights, the interior width of the trough corresponds approximately to the center-to-center spacing of the screws from each other plus twice the radius of one of the screws. The trough base has two circular regions spaced apart and disposed one beside the other and with radii of curvature is almost equal to the screw radius.

To obtain a sufficiently thorough mixing and, if necessary, a uniform wetting of the mixed material, the screw conveyor has a comparatively great length which requires a comparatively large expense in material and work time. At the same time the weight and the spatial requirements of the apparatus are considerable.

OBJECTS OF THE INVENTION

It is an object of my invention to provide a screw conveyor with none of the above-mentioned difficulties and disadvantages.

It is also an object of my invention to provide a screw conveyor in which a reduction in the structural length of the screw conveyor is attained with simple means and methods while maintaining at least the same thorough mixing and throughput as in the screw conveyor known heretofore.

SUMMARY OF THE INVENTION

These objects and others which will become more readily apparent hereinafter are attained, in accordance with my invention, in a screw conveyor, especially a screw conveyor having a plurality of motorized feed and mixing screw rotating in opposite rotational directions and running parallel to each other longitudinally in a common trough. In this screw conveyor, the feed and mixing screws each have a plurality of vanes spaced in series arranged in a helical flight, each extending radially from a shaft. The feed and mixing screws are spaced from each other laterally so that the vanes of one of the screws engage in gaps between the vanes of another adjacent screw.

According to my invention, each of the screws has more than one helical flight of vanes.

Thus it is possible, according to the invention, to make a screw conveyor with about half the length of the known screw conveyor and thus to achieve a considerable reduction in weight and manufacturing costs.

In a particularly desirable form of my screw conveyor which is especially functional and easy to manufacture in which the vanes are mounted on arms extending radially from the shaft, two supporting arms extend diametrically opposite each other, each having a vane.

Advantageously, the two opposite arms each carrying a vane positioned diametrically opposite each other are formed by a single linear rod which engages in a shaft passage extending diametrically in the shaft and is attached in the vicinity of the shaft passage with the shaft. Thus a feed and mixing screw with two helical flights of vanes results which are displaced from each other by a rotation of about 180°.

However, if two rods crossing at right angles are provided which each support a pair of opposite vanes, a conveyor with four helical flights of vanes per screw or shaft can be provided.

Advantageously, the vanes are mounted on the arms associated with them so that they are adjustable along the arms.

Thus in the simplest way possible, the eventual wear of the vane in the vicinity of its free end portion can be compensated by moving or adjusting the vane toward the outside so that the smallest possible spacing between the vane and the trough inner side is attainable even with a worn vane.

Furthermore, each of the vanes can be pivotably mounted on the shaft to be angularly displaced about its axis directed radially toward the shaft and is securable in a particular or selected orientation.

This has the advantage that by rotation of the vane about the above-named axis, the feed speed and thus the throughput can be increased and/or reduced and the degree of mixing can be changed continuously.

The rods are preferably formed as threaded rods and are attached to the shaft by two rod-securing nuts tightened to the shaft on opposite long sides of the shaft facing away from each other.

An advantageously functional and easy-to-make satisfactory attachment of the vanes and their supporting arms is attained when the vanes each have a sleeve engaging the arm formed as a threaded rod which is secured by a sleeve nut tightened on the facing surface of the sleeve.

An even more economical structure is provided when the sleeve has a threaded sleeve passage corresponding to the threaded rod and is mounted on the threaded rod by axially screwing and is detachably secured by one of the sleeve nuts tightened on the sleeve and screwed onto the threaded rod.

For further improvement of the feed and mixing of the bulk materials, the vanes are oriented at an obtuse angle open in the feed direction of the screws from the inside of the trough so that instead of pressing of bulk material onto the interior surface of the trough, it is shaved or scraped therefrom.

For further increasing the throughput, it is advantageous when a cover closing the top opening of the trough along its long side is positioned so that the trough and cover jointly form a duct closed on all sides along its long side and the duct has a profile substantially following the overall circumference of the screws.

The entire trough cross section can be used for feeding and mixing because of these features whereas in the known gutter-like trough, open on top, a satisfactory mixing is guaranteed only when it is filled about up to half the height of the trough with material.

It is advantageous for feeding and mixing of the bulk materials, to provide the circumferential arc length "L" of the vane so that at the maximum it corresponds to the arc length of the entire circumference or periphery of both screws divided by twice the number of helical flights of the screws; preferably, the circumferential arc length "L" is a third of that maximum value or the quotient referred to above. Also, the vanes of one screw are offset angularly with respect to the vanes of the adjacent screw, an amount corresponding to approximately the maximum arc length "L".

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
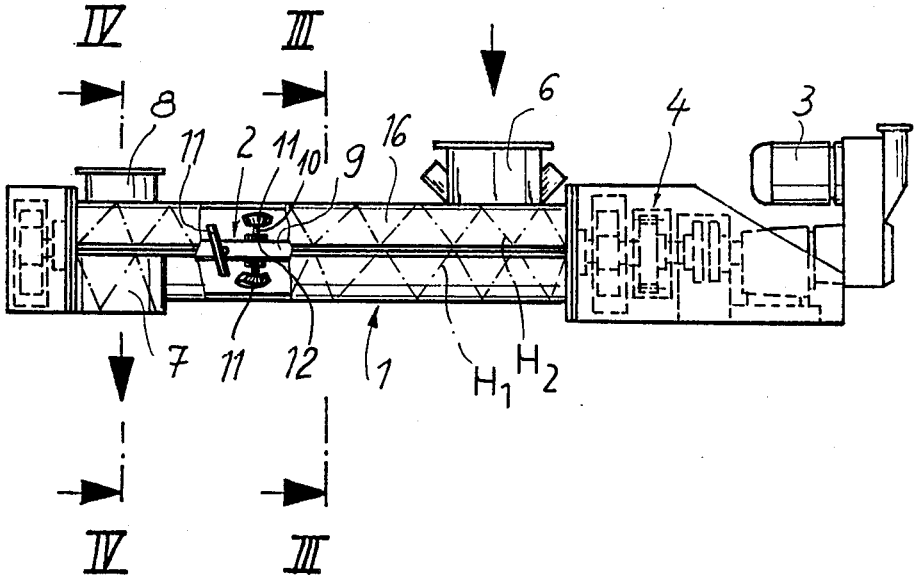
FIG. 1 is a partially broken-away front view of a screw conveyor according to my invention.
Figure 2:
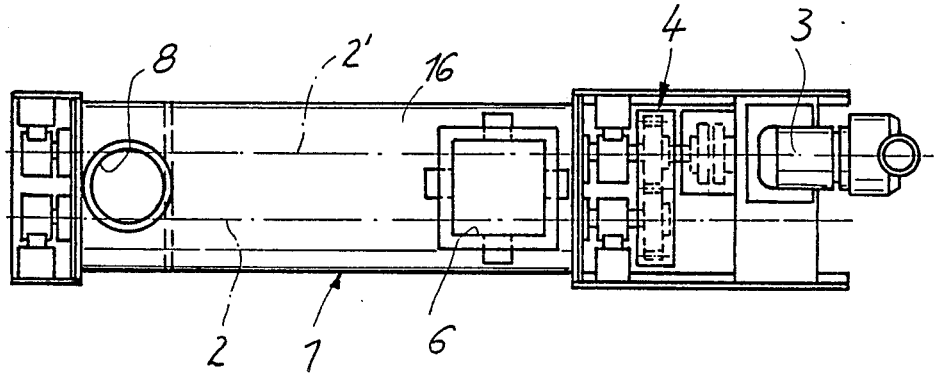
FIG. 2 is a top plan view of the screw conveyor shown in FIG. 1.

The illustrated screw conveyor comprises a trough 1, two substantially identical conveying and mixing screws 2, 2' positioned parallel to each other and extending longitudinally along the trough 1 which are rotatably drivable by a gear unit 4 in the direction of the arrow 5 (FIG. 3), a bulk materials inlet 6 and a bulk materials outlet 7 with a vapor discharge vent 8 positioned above it.

The screws 2, 2' are double threaded, i.e. their vanes define two helical flights $H_1$ and $H_2$ of vanes each. The interaxial spacing of the screws 2, 2' from each other is less than the diameter of one screw so that the screws are interfitted with each other along their long sides.

The helical flights each comprise a plurality of vanes 11 arranged in series in a helical arrangement and mounted on arms 10 extending radially from the advantageously pipelike or tubular shaft 9 of the screws 2, 2'.

The arms 10 for the vanes 11 are formed as threaded rods engaging in diametrically extending shaft passages 9' in the shaft 9 which are fixed in the axial direction by rod-securing nuts 12 tightened onto the shaft 9.

Figure 5:
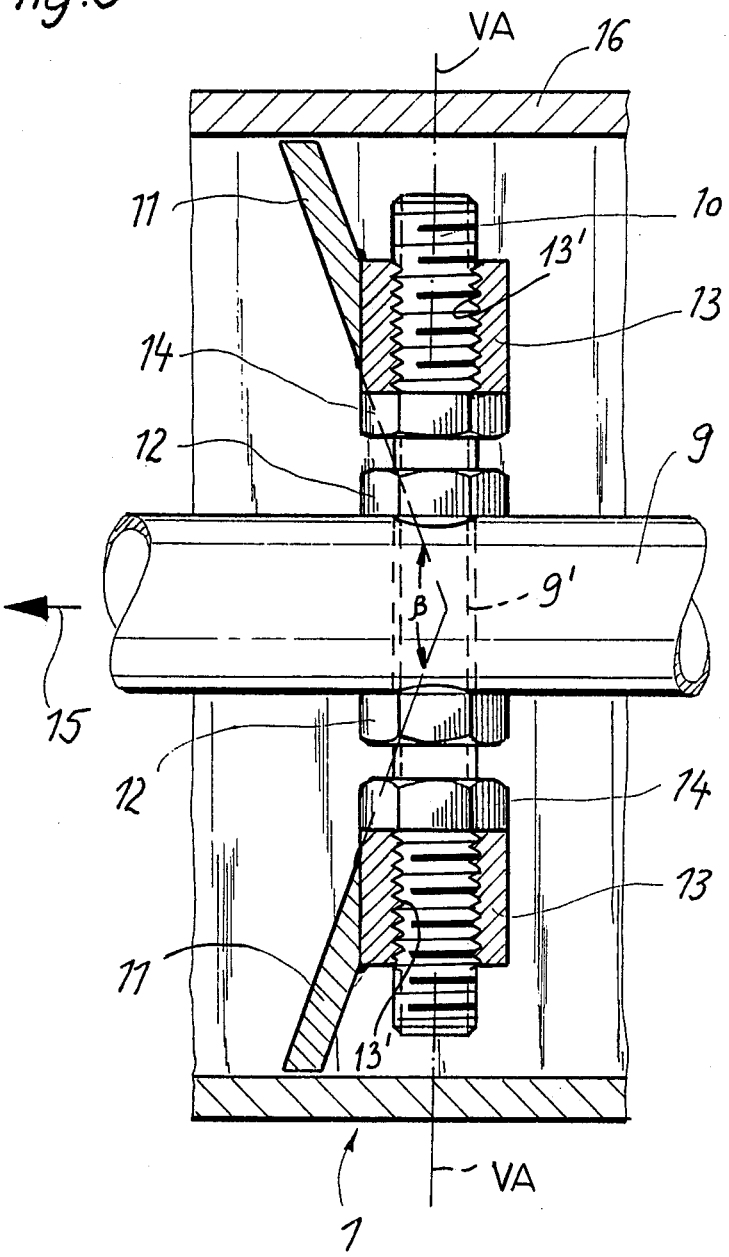
FIG. 5 is a front view of individual components of the screw conveyor shown in FIG. 1, drawn to a larger scale.

At each end region of one arm 10, a vane 11 is mounted so as to be adjustable over the longitudinal extent of the arm 10 and is rotatable about the threaded rod on an axis VA and is securable (FIG. 5).

Each of the vanes 11 is made with a sleeve 13 rigidly attached to it which has a threaded sleeve passage 13' which fits the threaded rod in which the arm 10, which is the threaded rod, is screwed. For rotationally securing the sleeve 13, sleeve nuts 14 can be tightened against the facing side of sleeve 13 and screwed onto the threaded rod. The vane 11 can be positioned as close as possible to the trough 1.

The vanes 11 are positioned at an obtuse angle 3 opening in the feed direction of the bulk materials (FIG. 5) so that the bulk material is lifted, forced or scraped from the inside of the trough 1 and a compaction of the bulk materials between the vanes 11 and the inside of the trough 1 is counteracted in a way which has been unattainable heretofore.

Figure 3:
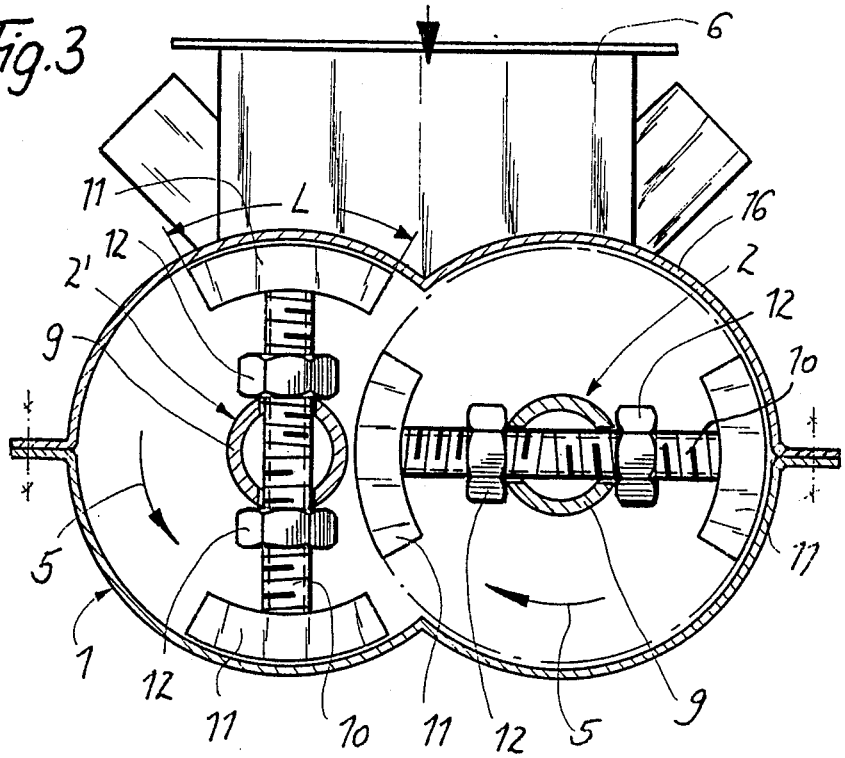
FIG. 3 is a cross-sectional view of the screw conveyor taken along the line III—III of FIG. 1 drawn to a larger scale.
Figure 4:
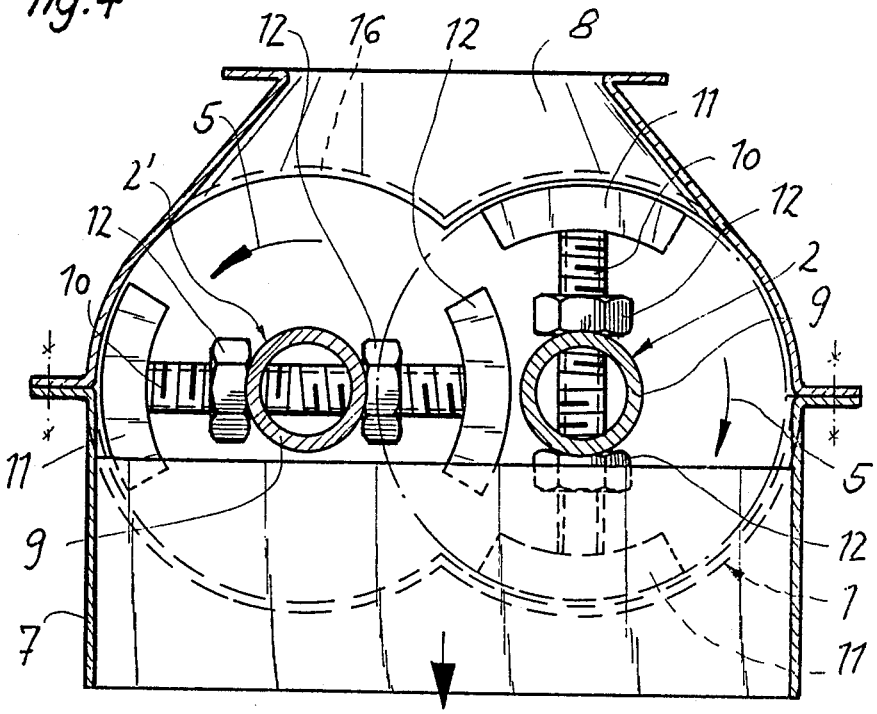
FIG. 4 is a cross-sectional view of the screw conveyor taken along the line IV—IV of FIG. 1 drawn to a larger scale.

The arc length "L" of each vane 11 corresponds approximately to a sixth of the arc length of the entire periphery of the screws (i.e. a sixth of the circumference) and the vanes 11 of one screw 2 are offset angularly with respect to the vane 11 of the other screw 2, by approximately 90° (FIGS. 3 and 4).

A cover 16 closing the top opening of the trough 1 is provided for the trough 1 so that a longitudinal duct results which is closed on all sides and which has an interior shape substantially following the circumference of both screws 2, 2' which corresponds to the shape of two equal circles engaged with each other whose centers are spaced from each other a distance which is less than the diameter of one of the circles.

However, the diameter of each circle is larger than the diameter of the screws by only approximately a comparatively small amount to provide play for the screw mounted rotatably in the duct.

Moreover, the trough 1 and the cover 16 extend only over half the circumference of the screws 2, 2' so that the trough 1 and the cover 16 attached to each other have the same shape. Furthermore, the vanes 11 of both screws 2, 2' overlap each other so that the entire inside of the trough 1 and the cover 16 are covered by the vanes without a gap.

All new individual features and combinations of features disclosed in the description and/or the drawing are to be considered as part of my invention.

I claim:

1. A screw conveyor comprising:

an elongated housing having opposite ends thereof;

a gear unit at one end of said housing;

two screws operatively connected with said gear unit in said end of the housing rotatable in opposite senses about respective axes of rotation, said screws extending longitudinally and substantially parallel to and being spaced apart from each other in said housing, said screws each comprising:

a shaft extending along the respective axis of rotation, a plurality of threaded rods extending radially to the respective axis of rotation of the respective screw on opposite sides of the shaft, each of said rods being secured thereto by at least one rod-securing nut and having opposite rod ends, a plurality of axially slidable sleeves, each of said sleeves rotatably mounted on the respective rod end and being formed with a vanes rigidly connected thereto, a pair of vanes of each of said rods being spaced from each other and having faces including an obtuse angle therebetween and defining a gap therebetween, so that said vanes of one of said screws engage in gaps between the vanes of the other one of said screws and said sleeves with respective vanes are adjustably positionable on said rods, and means for locking each of said sleeves at any desirable axial position along each one of said rods.

2. The screw conveyor defined in claim 1 wherein said means for locking are sleeve-securing nuts threaded onto the respective rods and braced against the respective sleeves.

3. The screw conveyor defined in claim 1 wherein each of said sleeves has the respective vane affixed to a longitudinal side of the sleeve.

4. The screw conveyor defined in claim 1, further comprising a cover closing said housing and positioned on said housing so that said housing and said cover form a common duct closed on all sides and said duct has a profile which substantially follows the entire circumference of both of said screws.

5. The conveyor screw defined in claim 1 wherein each of said vanes has a peripheral arc with an arc length thereof corresponding at maximum to the arc length of the entire periphery of said screws divided by twice the number of helical threads formed on said screws by said vanes, said vanes of one of said screws offset from the vanes of the other screw at an angle equal to said entire periphery of said screws divided by said length of said arc.

6. The screw conveyor defined in claim 5 wherein the length of one of said vanes corresponds to one-sixth of the circumference.

* * * * *